United States Patent [19]

Aalto et al.

[11] Patent Number: 4,625,626

[45] Date of Patent: Dec. 2, 1986

[54] CONTROL/FIRE DAMPER FOR DUCTS INVENTILATION INSTALLATIONS

[75] Inventors: Arvo Aalto; Erkki Aalto; Juhani Häsä ; Markku Penttilä , all of Kausala; Harri Saukkonen, Kouvola; Arvi Tolmunen, Kausala, all of Finland

[73] Assignee: Halton Oy, Finland

[21] Appl. No.: 629,832

[22] PCT Filed: Nov. 11, 1983

[86] PCT No.: PCT/FI83/00070

§ 371 Date: Jul. 6, 1984

§ 102(e) Date: Jul. 6, 1984

[87] PCT Pub. No.: WO84/01907

PCT Pub. Date: May 24, 1984

[30] Foreign Application Priority Data

Nov. 12, 1982 [FI] Finland ..... 823900

[51] Int. Cl.[4] ..... F24F 11/00

[52] U.S. Cl. ..... 98/1; 137/75; 251/95; 251/112; 251/113; 251/305

[58] Field of Search ..... 98/1, 40.06; 126/287.5; 137/72, 75, 77; 251/298, 304, 305, 95, 112, 113

[56] References Cited

U.S. PATENT DOCUMENTS

| | | | |
|---|---|---|---|
| 18,912 | 12/1857 | Ketcham | 251/298 X |
| 1,128,228 | 2/1915 | Collar | 251/112 |
| 2,218,330 | 10/1940 | Eliason | 137/72 X |
| 2,774,366 | 12/1956 | Dado | 137/75 |
| 4,512,356 | 4/1985 | Widerby | 98/1 X |

FOREIGN PATENT DOCUMENTS

| | | |
|---|---|---|
| 1116921 | 1/1982 | Canada . |
| 2261153 | 7/1974 | Fed. Rep. of Germany . |
| 148700 | 8/1983 | Norway . |

*Primary Examiner*—Harold Joyce

*Attorney, Agent, or Firm*—Steinberg & Raskin

[57] ABSTRACT

The control/fire damper (10) comprises a tubular shell (11) constituting a flow duct (12), a shaft (13) disposed within the flow duct (12) and carried by the shell (11), and a closing plate (14) mounted on the shaft (13), and which in the case of fire damper use continuously tends to close under the action of a spring (17). The control/-fire damper (10) is provided with a clamping counterpart (15) attached to the closing plate (14) and with a clamping device (16) passing through the shell (11), which fixes the counterpart (15) steplessly in the position which is desired in each instance. The clamping device (16) consists of a clamping screw and, in fire damper use, of a member attached by fuse material to the end of the clamping screw.

9 Claims, 13 Drawing Figures

CONTROL/FIRE DAMPER FOR DUCTS INVENTILATION INSTALLATIONS

BACKGROUND OF THE INVENTION

The present invention concerns a control/fire damper for ducts in ventilation installations, said control/fire damper comprising a shell constituting a flow duct, a closing member disposed inside the flow duct and which in fire damper use continuously tends to close under spring action, said control/fire damper being provided with a clamping counterpart attached to the closing member and with a clamping device passing through the shell and arranged to fix the counterpart by friction clamping in desired position, and said clamping device being clampable and releasable from outside the shell.

At present, in a number of structural designs known in the art, fixing of the closing plate in desired position is effected outside the damper by the aid of screw clamping between a sector plate or equivalent and its counterpiece. However, structures of this kind have the drawback of a certain space requirement outside the duct, which frequently entails difficulties in installation. In addition, the construction is susceptible to damage; it interferes with the lagging of the duct; and its appearance is not always acceptable, as is stated e.g. in the Norwegian patent application No. 802081.

In another structure known in the art, the fire limiter of the Finnish Pat. No. 54767, the fuse is a separate fuse attached to an adjusting cable or wire passing through the shell, and the closing plate is turnable into desired position with reference to the flow duct by the aid of the adjusting cable or wire, in order to produce the desired throttling. A drawback of this design is, in addition to inconvenient restoring operation after the closing plate has been trigged, that the fuse replacement operation is exceedingly cumbersome, and it is difficult after such replacement to reposition the closing plate exactly as before if the new fuse has different dimensions.

SUMMARY OF THE INVENTION

The object of the present invention is to provide an improvement in control/fire dampers known in the art. A more detailed object of the invention is to provide a control/fire damper having its clamping mechanism situated within the flow duct, yet permitting the closing member to be adjusted from outside the damper and, in the case of a fire damper, fuse replacement from the outside. A further object of the invention is to provide a fire limiter in which fuse replacement does not impede the resetting of the closing member of the fire limiter in its former position.

The aims of the invention are achieved by a control/-fire damper which is mainly characterized in that the clamping counterpart is located inside the shell.

The rest of the characteristic features of the control/-fire damper of the invention are described in detail below.

With the control/fire damper of the invention, numerous remarkable advantages are gained. In the control/fire damper of the invention, the clamping counterpart and the clamping device are located within the shell of the flow duct, where space is always to be found for them, and they are well protected, and not outside the flow duct as in the case of the prior art, where the availability of space is often restricted or its use may cause inconvenience for instance in connection with the lagging of the duct. It is moreover of importance that the setting of the closing member can be carried out from outside the damper with ease. It is moreover of primary importance that in the case of a fire damper the fuse, which may be made contiguous with the clamping screw, can be replaced from the outside of the damper, without access to the inside. An advantage lies moreover therein that the only necessary structural difference between a control damper and a combined control/fire damper is in the screw of the clamping device.

DESCRIPTION OF THE DRAWINGS

The invention is described in detail referring to certain advantageous embodiments of the invention presented in the figures of the drawing attached, to which the invention is not, however, intended to be exclusively confined.

DESCRIPTION OF THE PREFERRED EMBODIMENTS

Figure 1:
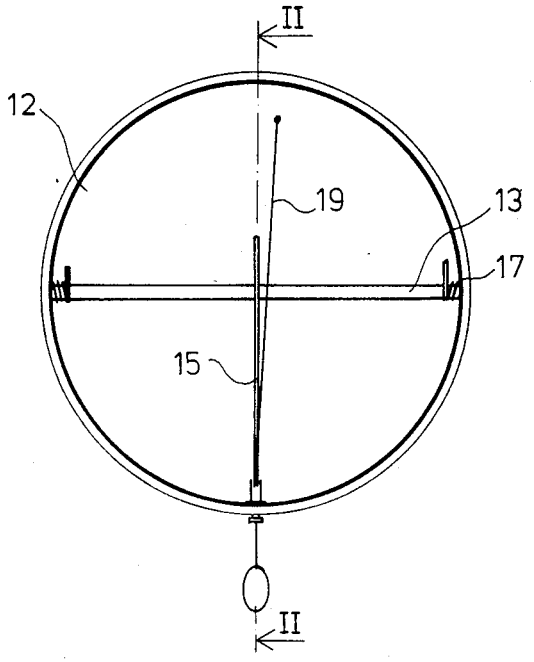
FIG. 1 presents a control/fire damper according to the invention in end view.
Figure 2:
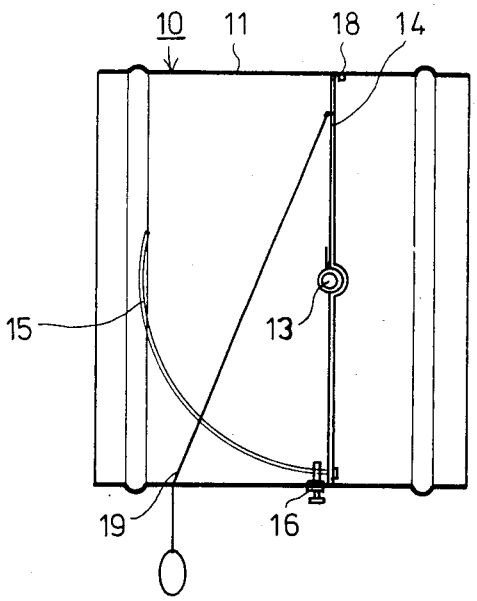
FIG. 2 shows a section along the line II—II in FIG. 1, with the closing plate in closed position.

The control/fire damper depicted in FIGS. 1 and 2 has been generally indicated by the reference numeral 10. The control/fire damper comprises a shell 11, constituting a through-flow duct 12. Within the flow duct 12 has been disposed a shaft 13, carried in the shell 11 by its ends. On the shaft 13 is mounted a closing plate 14 in the way that the closing plate 14 can turn from the closed position shown in FIG. 2, in which it is positioned substantially at right angles against the axial direction of the duct, to an open position in which it lies substantially parallel to the axial direction of the through-flow duct 12. In particular, as seen in FIGS. 1 and 2, the closing plate 14 is pivotally mounted on a shaft 13 so that its pivot axis passes transversely through the duct 12 at a substantially mid-height thereof.

Figure 7:
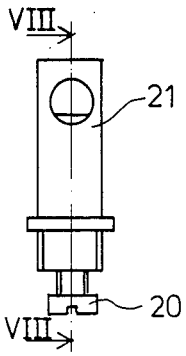
FIG. 7 presents an advantageous embodiment of the clamping device employed in the control/fire damper of the invention, in elevational view.
Figure 8:
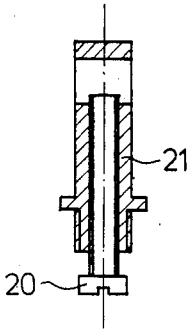
FIG. 8 presents the section along the line VIII—VIII in FIG. 7.

To the closing plate 14 is attached a clamping arc 15, which in the present embodiment is wire-like, and which passes through the clamping device 16, where the clamping screw 20 depicted in FIGS. 7 and 8 by mediation of the clamping arc 15 fixes the closing plate 14 in desired position. The force required for closing the closing plate 14 is obtained with the aid of closing springs 17 placed on the end, or ends, of the shaft 13. In order to pass through clamping device 16 as closing plate 14 rotates, it is understood that the center of curvature of clamping arc 15 coincides with the pivot axis of the closing plate 14.

In order that the closing plate 14, when closing, might remain in a position perpendicular to the flow duct 12, the control/fire damper 10 of the invention includes a limiter pin or limiter strips 18 serving to accomplish tight closure.

To the closing plate 14 is attached a control cable 19, passing out through the shell 11.

Figure 13:
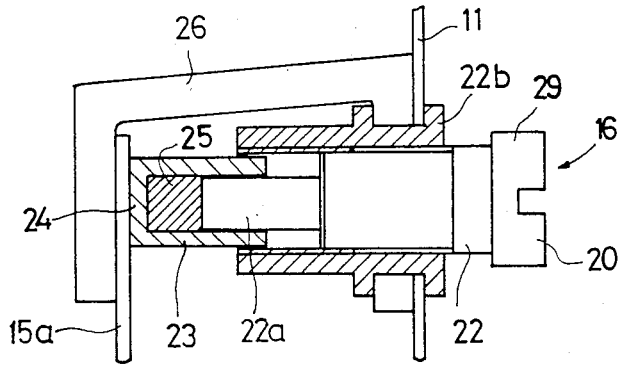
FIG. 13 presents a fuse design mounted on a fire damper, in schematic cross-section.

In the fire damper of FIGS. 1 and 2, it is possible to construct in connection with the clamping screw 20 a clamping fuse matching the construction. A fuse of this kind may, as shown in FIGS. 7, 8 and 13, be provided by joining to the end of the clamping screw 20 a member 23 furnished with fuse material 25, and which when the fuse material reaches its melting point becomes detached or moves, at the same time releasing the clamping arc 15 from its clamping whereby the closing plate 14 closes. Substitution of a new fuse for the old fuse is feasible with greatest ease by replacing the clamping screw 20.

The operation of the control/fire damper 10 of FIGS. 1 and 2 is as follows. When the control/fire damper 10 is joined to a duct in a ventilation system, the closing plate 14 is with the aid of the adjusting cable 19 placed in the desired open position. The clamping arc 15 is clamped to be immobile by means of the clamping device 16. If, in the case of a fire damper, the temperature in the flow duct 12 rises to a pre-determined limit value, the member 23 connected to the clamping screw 20 with fuse material becomes detached, or moves. Hereby, the closing plate 14 turns by action of the spring force of the closing spring or springs 17 and becomes closed against the limiter pin or strips 18. The resetting of the fire limiter 10 of the invention is simple and easy. To do this, it is merely necessary to install a new clamping screw 20, and the fire limiter 10 will be operative again.

Figure 3:
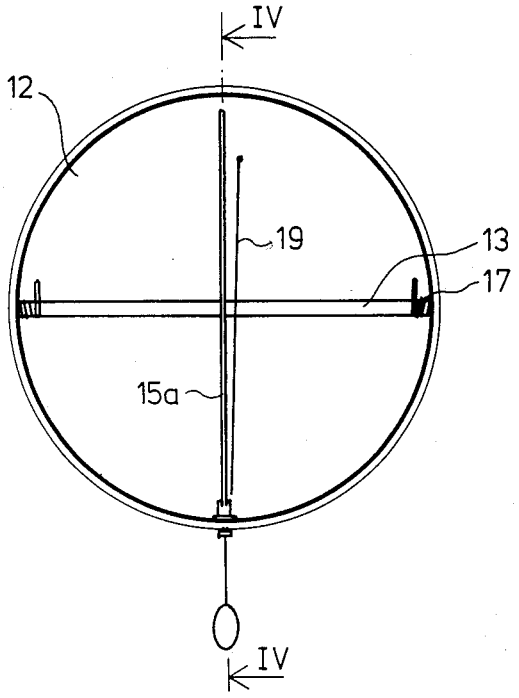
FIG. 3 presents another advantageous embodiment of the control/fire damper of the invention in end view.
Figure 4:
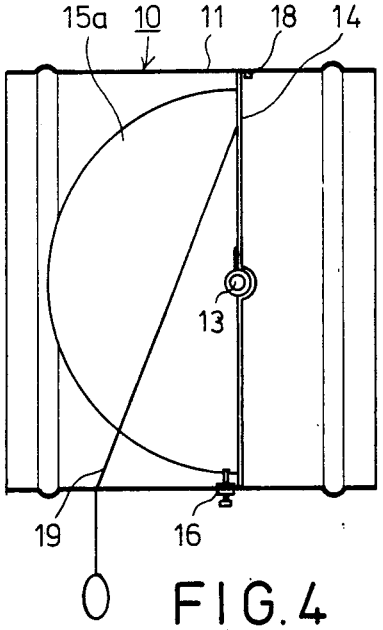
FIG. 4 presents the section along the line IV—IV in FIG. 3, with the closing plate in closed position.
Figure 9:
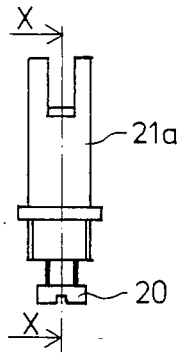
FIG. 9 presents another advantageous embodiment of the clamping device used in the control/fire damper of the invention, in elevational view.
Figure 10:
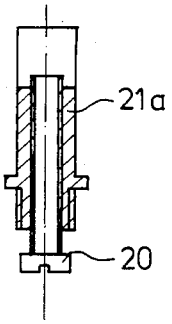
FIG. 10 presents the section along the line X—X in FIG. 9.

The embodiment depicted in FIGS. 3 and 4 is in other respects the same as the embodiment of FIGS. 1 and 2, except that in the embodiment of FIGS. 3 and 4 is used, for clamping arc 15*a*, a plate of which the margin has substantially the shape of a circular arc. A clamping device appropriate for this embodiment is presented in FIGS. 9 and 10, the clamping device presented here consisting of a clamping screw 20 and of a member 23, possibly joined with its end by fuse material 25 as in FIG. 13, this member being given such shape that it is appropriate for forming a clamping interlock with the plate 15*a*.

Fixing of the clamping arc 15*a* may alternatively be accomplished, as shown in FIG. 13, also in that to the shell 11 of the control/fire damper 10 is attached a shaped counterpiece 26, and a clamping arc 15*a*, in this embodiment advantageously located on one margin of the closing plate, is clamped with the aid of the clamping device and of said counterpiece so that the clamping arc 15*a* is impacted between the bottom 24 of the sleeve-like part 23 of the clamping device 16 and the counterpiece 26. Positive fixing of the clamping arc 15*a* is simply and easily accomplished by tightening the clamping screw 20 of the clamping device 16.

Figure 5:
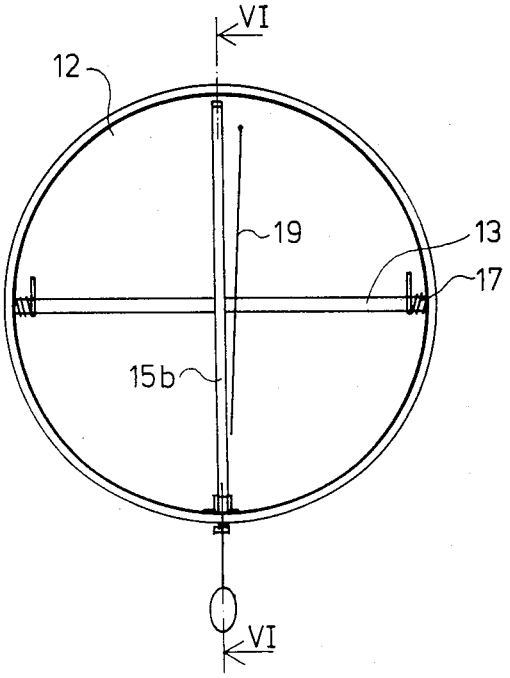
FIG. 5 presents a third advantageous embodiment of the control/fire damper of the invention in end view.
Figure 6:
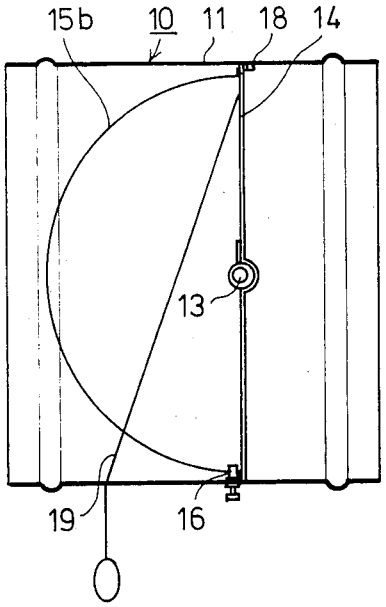
FIG. 6 presents the section along the line VI—VI in FIG. 5, with the closing plate in closed position.
Figure 11:
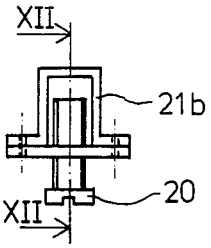
FIG. 11 presents a third advantageous embodiment of the clamping device used in the control/fire damper of the invention, in elevational view.
Figure 12:
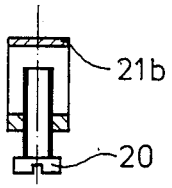
FIG. 12 presents the section along the line XII—XII in FIG. 11.

Also the embodiment depicted in FIGS. 5 and 6 is the same in other respects as the embodiment presented in FIGS. 1 and 2, except that in the embodiment of FIGS. 5 and 6 a sheet metal strip 15*b* is used for clamping arc. A clamping device appropriate for use in this embodiment is shown in FIGS. 11 and 12. In this embodiment, too, the clamping device 16 consists of a clamping screw 20 and a member 23, possibly joined as shown in FIG. 13 to its end by mediation of fuse material 25, and this member being so shaped that it is appropriate for interlocking with the rigid sheet metal strip 15*b*.

If it is desired to alter the position of the closing plate 14 of a control/fire damper 10 according to the invention which has been commissioned for use, in order to throttle the flow duct 12, any such control measure is easy and simple to carry out. It is then only necessary to free the clamping plate 15 from its clamping by the clamping device 16 and to pull the adjusting cable 19 outwards, whereby the closing plate 14 will correspondingly turn and throttle the flow duct 12. When the closing plate 14 has reached the desired control position, the clamping plate 15 is once again clamped to be immovable, by the aid of the clamping device 16.

In the control/fire damper of the invention, an adjusting cable 19 as in the figure is not absolutely necessary: it may be replaced by another equivalent design; for instance, one end of the shaft 13 may be bent to form a crank, or the end of the shaft 13 may be provided by milling with a screwdriver slot or spanner flats, or a hex screw head may be welded on, whereby adjustment becomes feasible with the aid of an appropriate tool.

We claim:

1. A control/fire damper for a duct in a ventilation installation, said duct comprising a shell defining an outer envelope and having an interior constituting a flow duct, comprising:

a closing member mounted within said flow duct for movement between a first closed position wherein flow through said duct from an upstream side of said closing member to a downstream side thereof is prevented, and a second open position wherein said flow is permitted;

a clamping counterpart fixed to said closing member within said flow duct for movement therewith, said clamping counterpart comprising a member positioned so that said member remains in entirely within the envelope defined by said flow duct shell both upstream and downstream of said closing member when said closing member is in said first closed position, said second open position and in positions intermediate of said first and second positions; and selectively actuatable clamping means for frictionally engaging said clamping counterpart upon actuation for fixing said clamping counterpart and closing member fixed thereto in a desired position, said clamping means passing through said shell of said flow duct, said clamping means including means for actuating the same which are operable from outside of said shell.

2. A control/fire damper according to claim 1 characterized in that said clamping means comprise a clamping screw and a member joined to the end of said clamping screw by mediation of fuse material.

3. The combination of claim 1 wherein said clamping means comprise a member having an end part associated therewith situated within said shell and further including a counterpiece comprising a member fixed to said shell, a portion of said counterpiece member being situated in opposed relationship to said end part associated with said clamping means member, said clamping means being actuatable to frictionally engage said clamping counterpart situated between said counterpiece member portion and said end part of said clamping means member.

4. The combination of claim 1 wherein said clamping counterpart member comprises an elongate wire member having a curvilinear shape.

5. The combination of claim 1 wherein said clamping counterpart member comprises a plate member having a marginal edge having a curvilinear shape.

6. The combination of claim 1 wherein said clamping counterpart member comprises a sheet metal strip having a curvilinear shape.

7. The combination of claim 1 wherein said clamping means are situated outside of the range of motion defined by said first closed and second open positions of said closing member.

8. The combination of claim 1 further including means for normally urging said closing member towards said first closed position.

9. The combination of claim 1 wherein said closing member is pivotally mounted within said shell for pivotal movement with respect to an axis passing substantially transversely through said flow duct at substantially a mid-height thereof and wherein said clamping counterpart member comprises a member defining a curvilinear shape having a center of curvature substantially coinciding with said pivot axis of said closing member.

* * * * *